US005601636A

United States Patent [19]

Glucksman

[11] Patent Number: 5,601,636

[45] Date of Patent: Feb. 11, 1997

[54] WALL MOUNTED AIR CLEANER ASSEMBLY

[75] Inventor: Dov Z. Glucksman, Wenham, Mass.

[73] Assignee: Appliance Development Corp., Danvers, Mass.

[21] Appl. No.: 453,896

[22] Filed: May 30, 1995

[51] Int. Cl.[6] ..... B03C 3/32

[52] U.S. Cl. ..... 96/63; 55/356; 55/422; 55/471; 96/80; 96/97

[58] Field of Search ..... 96/80, 55, 62, 96/63, 96, 97, 57, 58; 55/279, 356, 422, 471, 473; 261/24, 30, DIG. 17, DIG. 65

[56] References Cited

U.S. PATENT DOCUMENTS

| | | | |
|---|---|---|---|
| 3,422,263 | 1/1969 | Asahina | 361/231 |
| 3,937,967 | 2/1976 | Steinitz | 250/435 |
| 4,087,925 | 5/1978 | Bienek | 34/60 |
| 4,244,710 | 1/1981 | Burger | 96/97 X |
| 4,629,482 | 12/1986 | Davis | 55/471 X |
| 4,694,142 | 9/1987 | Glucksman | 392/360 |
| 4,808,347 | 2/1989 | Dawn | 261/30 |
| 4,873,422 | 10/1989 | Streich et al. | 392/363 |
| 4,968,456 | 11/1990 | Muderlak et al. | 261/30 |
| 5,133,042 | 7/1992 | Pelonis | 392/365 |
| 5,240,478 | 8/1993 | Messina | 55/356 X |
| 5,259,062 | 11/1993 | Pelonis | 392/365 |
| 5,300,139 | 4/1994 | Lin | 55/279 X |
| 5,332,425 | 7/1994 | Huang | 96/97 X |
| 5,373,581 | 12/1994 | Smith | 261/DIG. 65 |
| 5,407,469 | 4/1995 | Sun | 96/97 X |
| 5,484,472 | 1/1996 | Weinberg | 96/80 X |

*Primary Examiner*—Richard L. Chiesa
*Attorney, Agent, or Firm*—Sofer & Harooun, LLP

[57] ABSTRACT

An air cleaner assembly for ionizing and filtering air is supported by an electrical receptacle mounted in a wall. A housing supports an enclosed filter and a fan forces air into the housing, wherein the air is filtered and ionized. The filtered and ionized air is forced out of the housing through a grill mounted within the housing. A plug connected to the housing is mateable with the wall mounted electrical receptacle to provide power to the fan and to force air into the housing, through the filter, past the ionizer and out through the outlet grill.

13 Claims, 3 Drawing Sheets

WALL MOUNTED AIR CLEANER ASSEMBLY

FIELD OF THE INVENTION

This invention relates generally to an air cleaner assembly for filtering air and more particularly, to an assembly that filters and ionizes air.

BACKGROUND OF THE INVENTION

Air cleaner assemblies for filtering air and the like are known. Generally, these conventional electric air cleaners, which are designed to filter and ionize air in individual rooms or spaces within a house, are small portable units that sit on a floor or on a surface. These conventional units generally have a standard length power cord which is plugged into a receptacle to provide power for the unit. However, such conventional air cleaners take up floor space or counter space. Additionally, when positioned on the floor, they are prone to numerous safety hazards from children and pets. Furthermore, with these floor positioned units, even adults may accidently trip and fall over these devices. Therefore, it would be advantageous to provide an air cleaner which would save floor space or counter space, that is safe when used around children, pets and adults and that is unobtrusive and blends in with the surrounding area.

Accordingly, many attempts have been made to overcome the problems associated with the use of air cleaner assemblies. However, prior art air cleaning apparatuses have suffered from a variety of drawbacks and deficiencies.

For example, U.S. Pat. No. 5,133,042 to Pelonis discloses an air treatment apparatus utilizing interchangeable cartridges. Each cartridge has an apertured support structure and an air treatment element that alters a particular characteristic of an air flow through the cartridge. However, this reference has the same drawbacks mentioned above. Specifically, it requires a power cord extending to an A.C. receptacle.

U.S. Pat. No. 4,873,422 to Streich et al. Discloses a heater assembly supported by an electrical receptacle mounted in a wall. However, this reference does not teach or disclose a wall mounted air filter having a filtering means for filtering air. Moreover, this reference does not teach or suggest an ionization means disposed within the housing for removing positively charged ions and from the filtered air.

U.S. Pat. No. 4,629,482 to Davis, discloses a portable room air purifier having replaceable air filters which are mounted to receive incoming air which is drawn therethrough by a centrifugal fan. However, this reference does not teach or disclose a wall mounted air filter having a filtering means for filtering air. Moreover, this reference does not teach or suggest an ionization means disposed within the housing for removing positively charged ions into the filtered air.

U.S. Pat. No. 4,694,142 to Glucksman discloses an electric forced-convection air heater having an axial fan and a cage-shaped resistance heating element mounted up-stream of the fan impeller. Again, this reference does not teach or disclose a wall mounted air filter having a filtering means for filtering air as well as an ionization means disposed within the housing for removing positively charged ions into the filtered air.

U.S. Pat. No. 3,937,967 to Steinitz discloses an electronic air purifying method and apparatus whereby the air to be purified is introduced into the apparatus wherein oxygen molecules of air are first transformed into the allotropic form of oxygen by a low pressure mercury ultra violet radiating device and then decomposed to nascent oxygen by heat. Again, this reference suffers from the same drawbacks mentioned before. In particular, the device requires an electrical cord. As well, the device is not configured to be compact and takes up large amounts of floor or counter space.

U.S. Pat. No. 3,422,263 to Asahina discloses an ionized air producing device. However, Asahina's device does not teach or suggest a compact system and also suffers from the same drawbacks noted above.

OBJECTS AND SUMMARY OF THE INVENTION

It is therefore an object of the present invention to provide an air cleaner assembly for filtering air.

Another object is to provide an air cleaner assembly for filtering and ionizing air.

A further object of the invention is to provide an air cleaner assembly which eliminates the standard length power cord and which can be plugged into a receptacle to provide power to the unit, therefore decreasing the area of use required by such an apparatus.

Another object is to provide an air cleaner assembly which does not take up valuable floor space or counter space and which also eliminates the safety hazards present with prior art floor or counter mounted units.

An additional object of the invention is to provide an air cleaner that is safe when used around children, pets and adults and is unobtrusive and blends in with the surrounding area.

These and other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

According to the present invention, a wall mounted air cleaner assembly for filtering air is provided, wherein the air cleaner is supportable by an electrical receptacle mounted in the wall. The air cleaner assembly includes a housing having a grill means for discharging filtered air, a filtering means for filtering air and a fan means for forcing air into the housing and through the filtering means. The air cleaner assembly may also include an ionization means disposed within the housing for removing positively charged ions into the filtered air, thus ionizing the air. The ionization means is provided with at least one ionization pin disposed between the grill means and the fan means.

A power plug is provided, which, is mateable directly with the wall mounted electrical receptacle to provide power to the fan means for forcing air into the housing only when the plug is mated with the receptacle. The plug acts to directly support the housing when it is mated with the receptacle.

One advantage of this feature is that, should the air cleaning assembly be disengaged from the wall mounted receptacle, power is immediately removed from the assembly.

According to another aspect of the invention, a second insulated plug is provided which is connected to the rear cover or housing of the air cleaner. This second plug or set of blades engages the second outlet in order to firmly secure the assembly to the electrical receptacle.

In the preferred embodiments of the present invention, the air cleaning assembly includes means for filtering air and ionization means for introducing negatively charged ions into the filtered air. Both the filtering and ionization means are contained in a housing, the housing having a circular rear cover and a circular front cover coupled to the circular rear cover. The circular front cover includes a front grill disposed within the front cover for expelling filtered ionized air. The front cover also includes a perimeter wall which includes air inlet openings.

According to one embodiment, the filtering means which is contained within the housing, includes a fluted filter and a charcoal filter disposed within the fluted filter. The filtering means is disposed between the rear and front covers of the housing. Additionally, the filtering means is disposed circumfentially about the fan means and adjacent the air inlet openings in the front cover perimeter wall.

Switch means connected between the plug and the fan means are provided for controlling the operation of the air cleaner assembly. Connecting means between the plug and the ionization means are provided for permitting operation of the fan means independently of the ionization means.

BRIEF DESCRIPTION OF THE DRAWINGS

In the drawings, wherein like reference numerals identify similar elements throughout the several views.

DETAILED DESCRIPTION OF THE PREFERRED EMBODIMENTS

Figure 1:
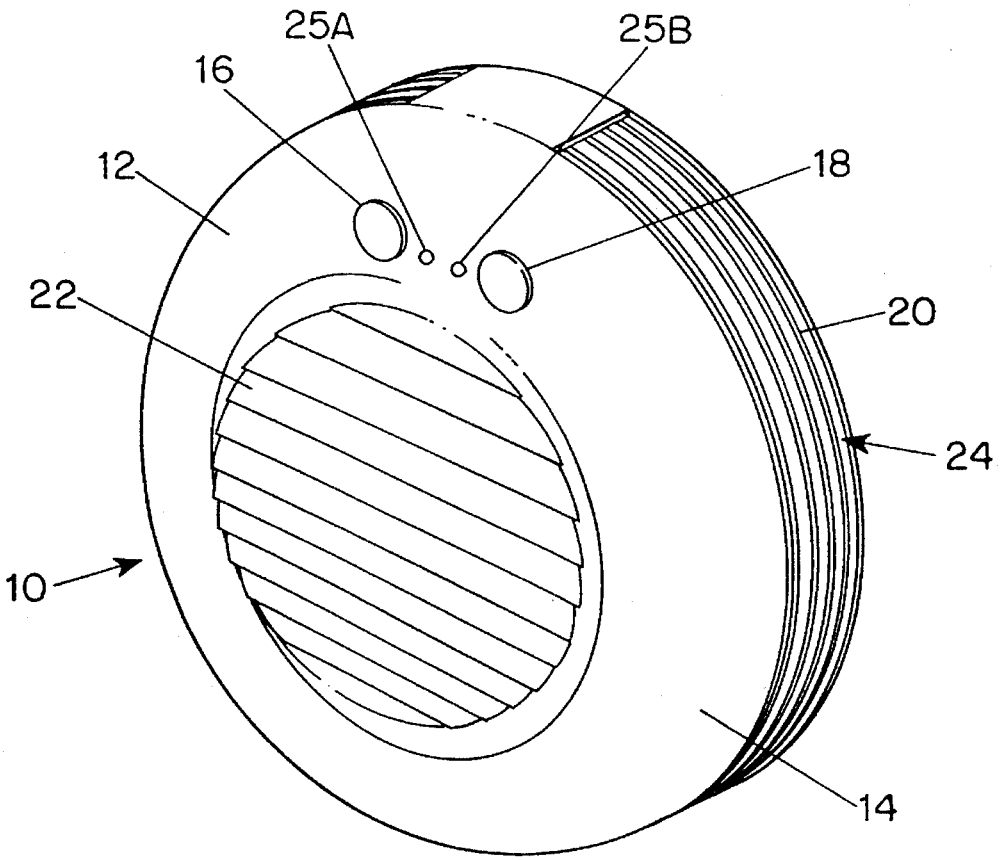
FIG. 1 is a perspective view of the front cover of an air cleaner assembly constructed in accordance with an illustrative embodiment of the present invention.

FIG. 1 shows an air cleaner assembly 10 according to the present invention. The air cleaner assembly 10 is mountable on a conventional A.C. receptacle (not shown) for receiving power for its operation. The air cleaner assembly 10 includes a cylindrically shaped from housing 12 and a rear housing 60 shown in FIG. 4 which may also be cylindrically shaped. Also as shown in FIG. 3B, the rear housing 60 includes a rear panel 28 enclosing the internal space of the air cleaner assembly 10.

Referring back to FIG. 1, the front housing 12 covers the internal components of the air cleaner assembly 10. The front housing 12 includes a circularly shaped from cover 14 defining an air outlet grill 22 which may be rotatable within front housing 12. The from housing 12 also has a perimeter wall 24, defining an air inlet grill 20. The air inlet grill 20 may cover all or only a portion of the perimeter wall 24 of the front housing 12. Control switches 16 and 18 are disposed on the from cover 14 and are used to control one of the available modes of operation of the air cleaner assembly 10. According to one embodiment of the invention, switch 18 is used to turn on the power provided to the air cleaner assembly 10 to activate a fan disposed inside the air cleaner assembly. Switch 16 is turned on to activate an ionizer pin 30, here shown by way of example as one pin, located within the air cleaner assembly 10. Light indicators 25A and 25B are respectively placed next to control switches 16 and 18 to indicate the mode of operation of the air cleaner assembly 10.

Figure 2:
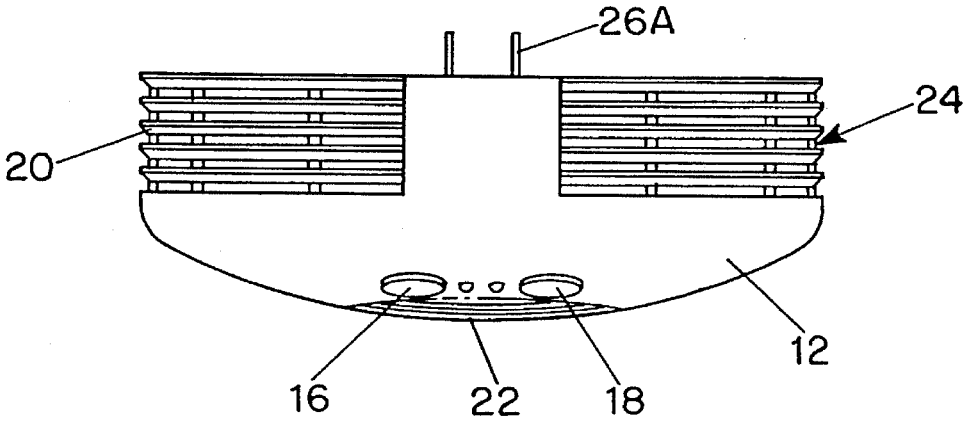
FIG. 2 is a top view of the front cover of the air cleaner assembly as shown in FIG. 1.

FIG. 2 illustrates a side view of the front housing 12. A.C. plugs 26A extend outwardly from the rear panel 28 for insertion into a conventional A.C. receptacle (not shown). Air inlet grill 20 is formed on a portion of the perimeter wall 24.

Figure 3A:
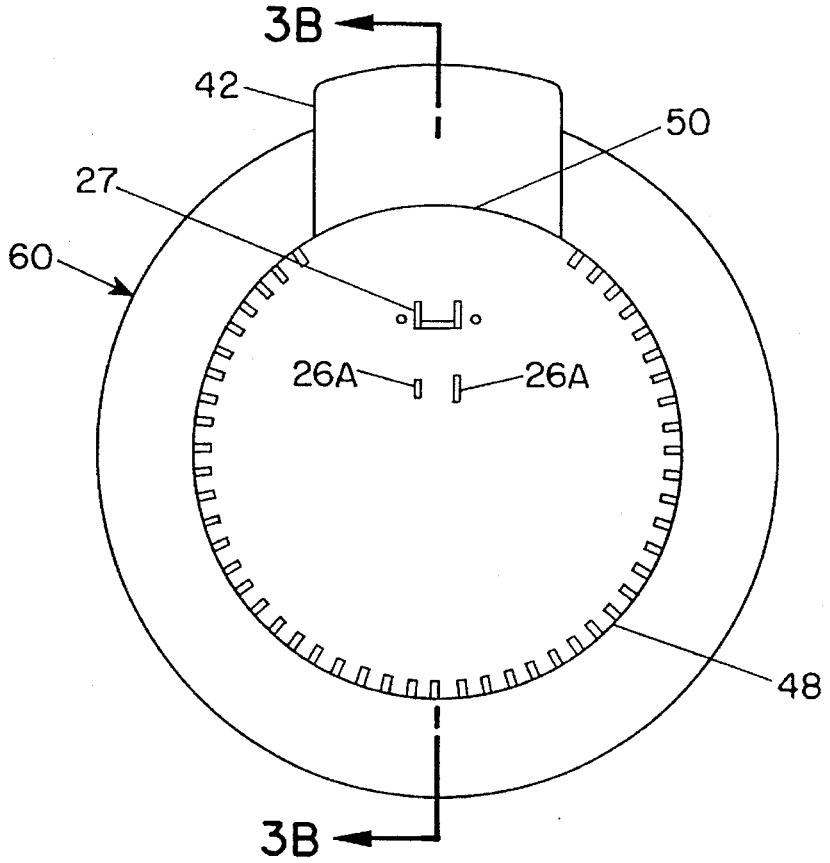
FIG. 3A is a rear elevational view of the rear cover of the air cleaner assembly of FIG. 1.
Figure 3B:
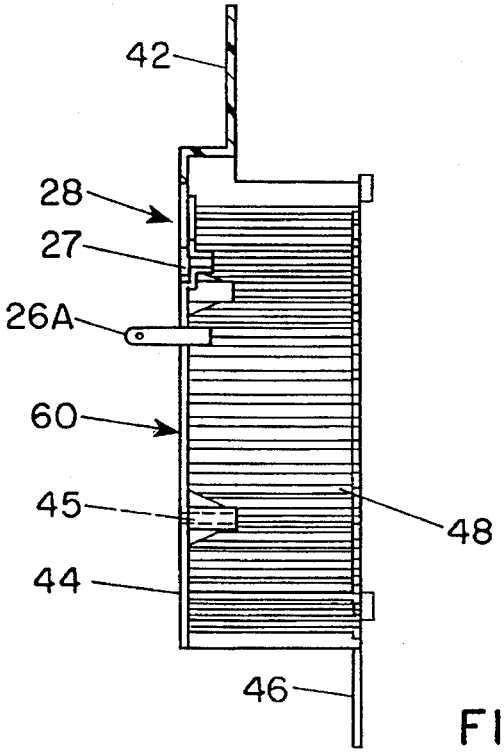
FIG. 3B is a side view of the rear cover of the air cleaner assembly of FIG. 3A.

The rear housing 60 of the air cleaner assembly 10 is shown in FIGS. 3A and 3B. The rear panel 28, as shown in FIG. 3B, includes a bottom portion 44 and a top portion 42 extending from the middle portion at a recess. The rear housing 60 includes a cylindrically shaped cage 48 securely attached to the rear panel 28. A screw hole 45 extends outwardly from the internal surface of rear panel 28. As illustrated in FIG. 3A, the upper portion 50 of cage 48 is open. A first support panel 46 extends downwardly from the bottom portion of cage 48. The first support panel 46 is used to attach the rear housing 60 to the front housing 12 by screw 82 shown in FIG. 4. Alternatively, the front and rear housings, 12 and 60, may be snap fitted together without any such screw assemblies. Cage 48 provides for the passage of air from its outside perimeter toward its interior.

Figure 4:
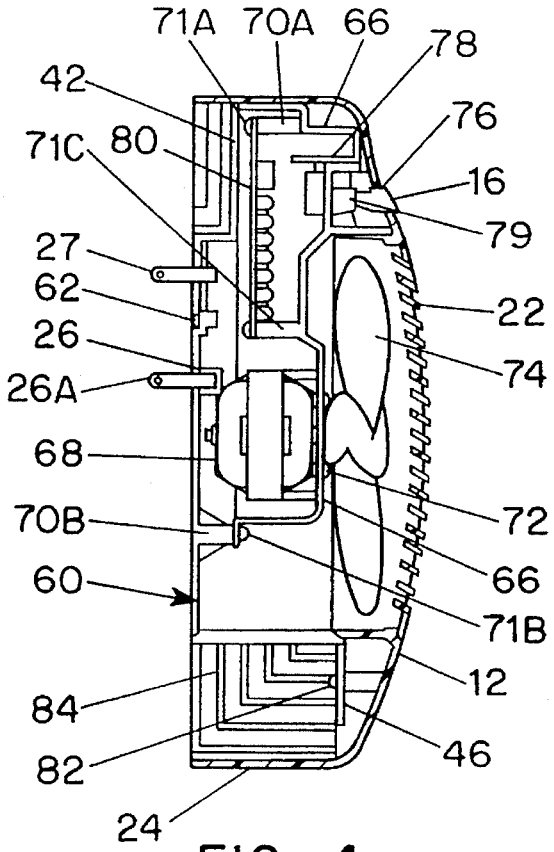
FIG. 4 is a cross sectional side view of the air cleaner assembly, so as to show the front and rear covers, a filter means, a fan means and an ionization means.

Referring to FIG. 4, the internal components of the air cleaner assembly 10 are shown in more detail. The front housing 12 is removably connected to the rear housing 60. A plug base 26 is securely attached to the internal surface of the rear housing 60 by screws 62, one of which is shown. Plugs 26A extend outwardly from the plug base 26, and protrude outside the rear housing 60. Plugs 26A directly support the air cleaner assembly 10 when inserted into a wall mounted receptacle (not shown). In a preferred embodiment of the present invention, the air cleaner assembly 10 includes an additional pair of plugs 27 that are made of plastic. This embodiment of the air cleaner assembly 10 can be used with a wall mounted receptacle having two A.C. outlets (not shown). Plugs 26A are inserted into one receptacle outlet and plugs 27 are inserted in the second outlet. In this arrangement, plugs 27 function as additional support and securement of the air cleaner assembly 10 to the electrical receptacle. Since plugs 27 are made of plastic they do not provide electric current. Additionally, plugs 27 may be configured to swing inwardly towards the rear housing 60 such that when completely flipped, they align flush with the rear housing 60. This arrangement allows plugs 26A to be mounted into a single outlet receptacle (not shown).

A second support panel 66 extends horizontally from the top portion 42, then vertically down through the open portion 50 of cage 48, and then horizontally towards a screw hole 70B. The second support panel 66 is securely attached to the rear housing 60 by screws 71A and 71B.

The second support panel 66 acts as a base support for motor 68, which is securely attached to the support panel by screws 72. Motor 68 is a Johnson type circular motor model no. 5812, mounted on the support panel 66 with its shaft extending in a direction orthogonally from the support panel. The motor 68 can operate in two speeds. Typically, the high speed is used for day operation and the low speed is used for night operation, when lower noise level is desired. The upper portion of the second support panel 66 acts as a support base for the printed circuit board 80, which is securely attached to the second support panel 66 by screws 71A and 71C.

The upper portion of support panel 66 includes two apertures, one of which is shown, for supporting switches 16 and 18. A spring mechanism 76 is coupled to the switch 16 on one end, and to a switch actuator 79 at the other end. Switch actuator 79 is coupled to portion 78 of the printed circuit board 80. Switch 16 is actuated by pressure on the spring mechanism 76. Plugs 26A provide electrical power for the operation of circuit components on printed circuit board 80 and motor 68. Although not shown in FIG. 4, switch 18 operates in the same way as switch 16.

Figure 5:
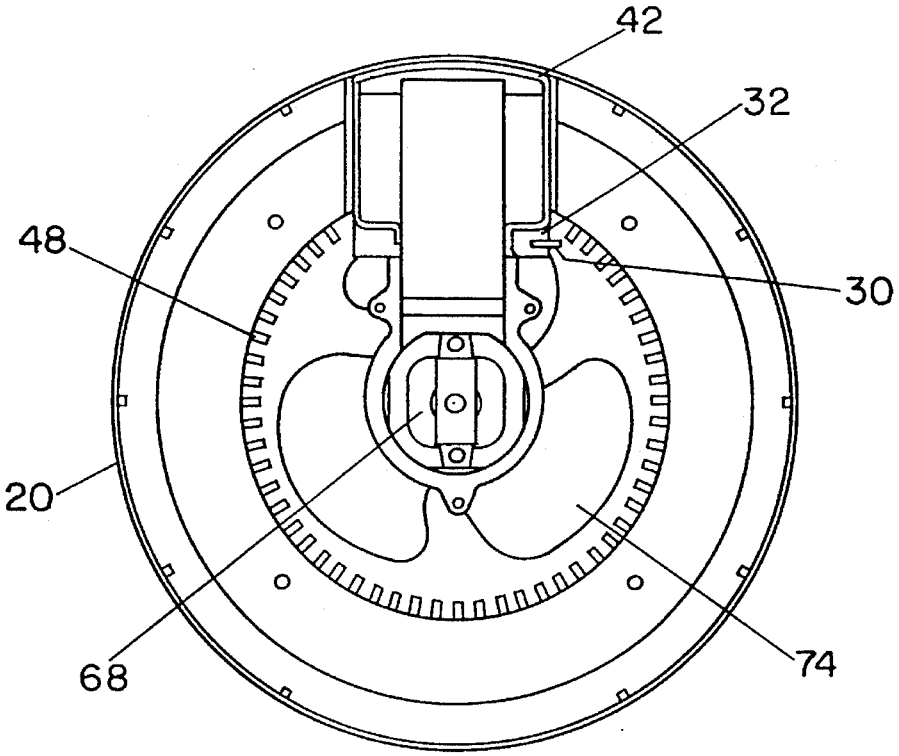
FIG. 5 is a rear view of the front cover of the air cleaner assembly of FIG. 1.

With reference to FIG. 5, the ionizer pin 30 is shown supported on an ionizer pin support 32 both of which are positioned within the cylindrical shaped cage 48. The ionizer pin 30 is coupled to the printed circuit board 80, the circuit board 80 being connected to a source of electricity. In this way and when ionizer control switch 16 is activated, the ionizer pin 30 is charged with a source of negatively charged electricity. Accordingly, the negatively charged ionizer pin attracts positively charge ions that are present in the filtered air. As in the case of all matter, air is made up of molecules, each molecule having a core, or nucleus of charged protons surrounded by negatively charged electrons. As nature constantly seeks an equilibrium, it seeks a balance in which there are as many electrons as protons so that the positive and negative charges cancel one another out. Thus, as the positively charged ions are canceled with the newly created negative charges, the ratio of negatively charged ions in the filtered air stream is increased at a direct proportion to the positively charged ions that are canceled out by the ionization pin 30.

It is to be understood that any type or method of removing positively charged ions from the filtered air stream is contemplated. For example, other embodiments may include negatively charged plates or surfaces that are able to attract and cancel positively charged ions.

A conventional fan 74 is mounted on and driven by motor 68, for blowing air towards grill 22. Fan 74 can also be of the type disclosed in the U.S. Pat. No. 4,694,142 the teachings of which are incorporated herein by reference.

The bottom portion of support panel 46, as shown in FIG. 4, is securely attached to the front housing 12 by screws 82, one of which is shown. The space defined by the outside surface of cage 48 and internal spaces of panel 46 and 28 is used to contain a filter 84. In a preferred embodiment of the present invention, filter 84 includes a fluted precharged media with a circular charcoal filter within the fluted filter, although any type of filtering media such as paper, cloth or porous foam may be used. Filter 84 is removably disposed around the cage 48.

During operation, the air cleaner assembly 10 is plugged into a conventional A.C. receptacle. As mentioned previously, plugs 26A support the air cleaner assembly 10 from the A.C. receptacle. Switch 18 is pressed to operate fan 74, which draws air through air inlet grill 20. The air drawn into the air cleaner assembly 10 first passes through the filter 84. The filter 84 filters the air which passes through the cage 48 and thereafter is forced out through outlet grill 22 by fan 74. When the ionization feature of the air cleaner assembly is desired, switch 16 is pressed. This activates the ionizing circuitry located on the printed circuit board 80, which in turn activates the ionization pin 30. The active ionization pin 30 acts so that only negatively charged ions may pass through the outlet grill 22 and that positive ions may be attracted to the ionization pin 30 resulting in a flow of filtered air from the outlet grill 22 which is negatively ionized. As a result, the air coming out of outlet grill 22 is both filtered and negatively ionized.

Thus, the air cleaning assembly 10 provides a cordless air filter and ionizer that can be conveniently used in households and offices. Although some embodiments of the air cleaning assembly have been described in detail, other variations and modifications exist that fall within the spirit and the scope of the present invention.

It should be understood that the preferred embodiments and examples described are for illustrative purposes only and are not to be construed as limiting the scope of the present invention which is properly delineated only in the appended claims.

What is claimed is:

1. An air cleaner assembly for filtering air in a space contained at least in part by a wall, the air cleaner assembly being adapted to be supported by an electrical receptacle mounted in the wall, the air cleaner assembly comprising:

a housing having a perimeter wall including inlet grill means for drawing air into the cleaner assembly, and outlet grill means for discharging filtered air from the cleaner assembly;

filtering means for filtering air, said filtering means comprising a filter disposed within said housing;

fan means for directing air into said housing and through said filtering means when receiving electrical power and for producing filtered air, said filtered air discharged out of said outlet grill means, said filtering means disposed circumferentially about said fan means and adjacent to said inlet grill means so that said fan means draws air into said inlet grill means through said filter means and discharges said filtered air out through said outlet grill means; and a plug, directly attached to said housing that is mateable directly with the wall mounted electrical receptacle to provide power to said fan means for directing air into the housing only when the plug is mated with the receptacle.

2. The air cleaner assembly of claim 1, further comprising an ionization means disposed within said housing for removing positively charged ions from said air.

3. The air cleaner assembly of claim 2, further comprising connecting means between said plug and said ionizing means for permitting operation of the fan means independently of said ionizing means.

4. The air cleaner assembly of claim 2, wherein said ionization means further comprises at least one ionization pin disposed between said filtering means and said outlet grill means.

5. The air cleaner assembly of claim 1, wherein said housing includes a circular rear housing and a circular front housing coupled to said circular rear housing, said grill means disposed within said circular front housing.

6. The air cleaner assembly of claim 1, wherein said outlet grill means is rotatable within said housing for directing air into the space.

7. The air cleaner assembly of claim 1, wherein said filtering means comprises a fluted filter and a charcoal filter.

8. The air cleaner assembly of claim 1, further comprising switch means mounted on said housing and electrically connected between said plug and said fan means for controlling operation of the air cleaner assembly.

9. An air cleaner assembly for ionizing and filtering air, the air cleaner assembly comprising:

a housing having a front surface and a perimeter wall, said front surface having an outlet grill for expelling ionized filtered air, said perimeter wall having an air inlet grill;

filtering means for producing filtering air, said filtering means comprising a filter disposed within said housing and proximate said inlet grill;

fan means for directing air into said housing and through said inlet grill and said filtering means when receiving electrical power, said filtering means disposed circumferentially about said fan means and adjacent to said air inlet grill so that said fan means draws air into said air inlet grill through said filter means and discharges said filtered air out through said outlet grill;

ionization means disposed between said outlet grill and said filtering means for removing positively charged ions from the filtered air; and a plug, directly attached to said housing, that is mateable directly with a wall mounted electrical receptacle to provide power to said fan.

10. The air cleaner assembly of claim 9, wherein said ionization means further comprises at least one ionization pin disposed between said filtering means and said outlet grill means.

11. The air cleaner assembly of claim 9, wherein said housing includes a circular rear housing and a circular from housing coupled to said circular rear housing, said grill means disposed within said circular front housing.

12. The air cleaner assembly of claim 9 further comprising switch means mounted on said housing and electrically connected between said plug and said fan means for controlling operation of the air cleaner assembly.

13. The air cleaner assembly of claim 9, further comprising connecting means between said plug and said ionization means for permitting operation of the fan means independent of said ionization means.

* * * * *